United States Patent [19]

Komendowski

[11] 4,199,126

[45] Apr. 22, 1980

[54] ONE-PIECE EASEL-SUPPORT MEMBER

[75] Inventor: Henry Komendowski, Des Plaines, Ill.

[73] Assignee: Intercraft Industries Corporation, Chicago, Ill.

[21] Appl. No.: 927,374

[22] Filed: Jul. 24, 1978

[51] Int. Cl.[2] ..... A47B 97/04

[52] U.S. Cl. ..... 248/463; 248/174

[58] Field of Search ..... 248/460, 463, 464, 465, 248/454, 455, 174

[56] References Cited

U.S. PATENT DOCUMENTS

| | | | |
|---|---|---|---|
| 2,591,170 | 4/1952 | Levinson et al. | 248/456 |
| 3,411,741 | 11/1968 | Nadler | 248/463 X |
| 3,693,926 | 9/1972 | Carter | 248/460 |
| 3,707,791 | 1/1973 | Levy | 248/463 X |
| 3,833,098 | 9/1974 | Alderman | 248/460 X |

FOREIGN PATENT DOCUMENTS

| | | | |
|---|---|---|---|
| 69966 | 4/1910 | Fed. Rep. of Germany | 248/456 |
| 793630 | 1/1936 | France | 248/463 |
| 1524764 | 4/1968 | France | 248/463 |
| 164133 | 6/1921 | United Kingdom | 248/463 |
| 250707 | 4/1926 | United Kingdom | 248/463 |
| 419326 | 11/1934 | United Kingdom | 248/464 |

*Primary Examiner*—J. Franklin Foss

*Attorney, Agent, or Firm*—Vogel, Dithmar, Stotland, Stratman & Levy

[57] ABSTRACT

The one-piece easel-support member comprises attachment means for attachment to the back of a picture frame, a stand hingedly connected to the attachment means, a flap, and a link hingedly interconnected to the attachment means and to the flap. The easel-support member also comprises latching structure which includes one latching element on the flap and two latching elements on the stand. The latching element on the flap is engageable with one of the elements on the stand to place the easel-support member in its storage position. The flap latching element is also engageable with the other latching element on the stand to place the easel-support member in its use position.

20 Claims, 9 Drawing Figures

FIG. 5
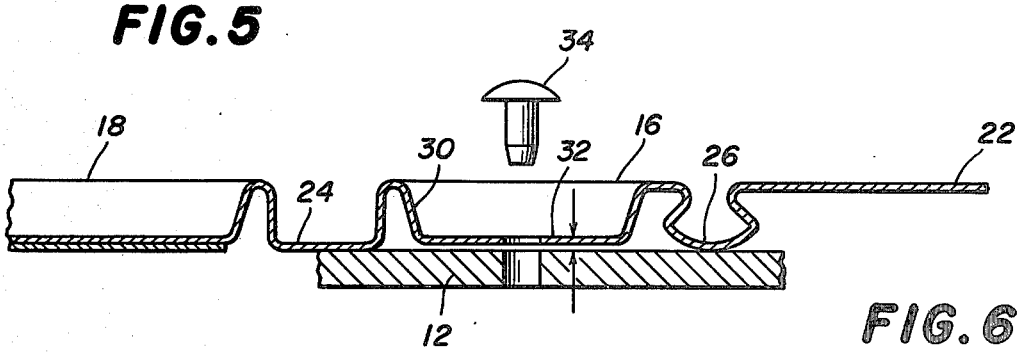
FIG. 6
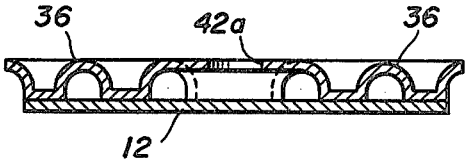
FIG. 7
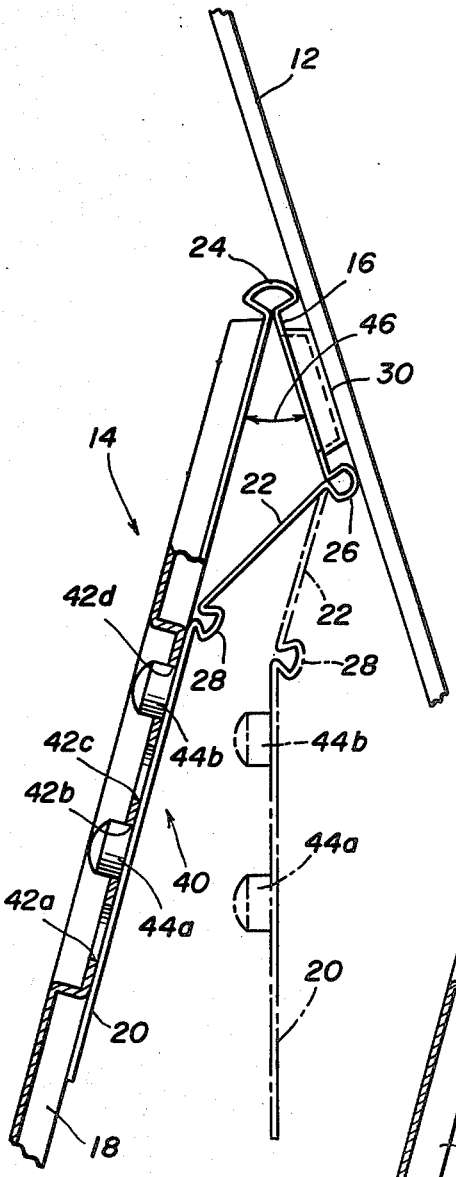
FIG. 8
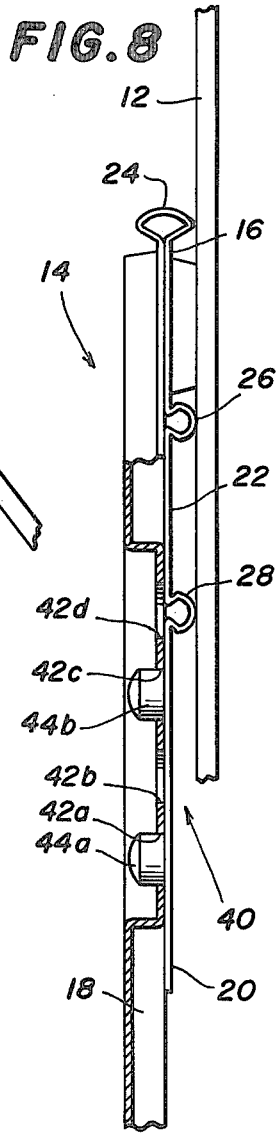
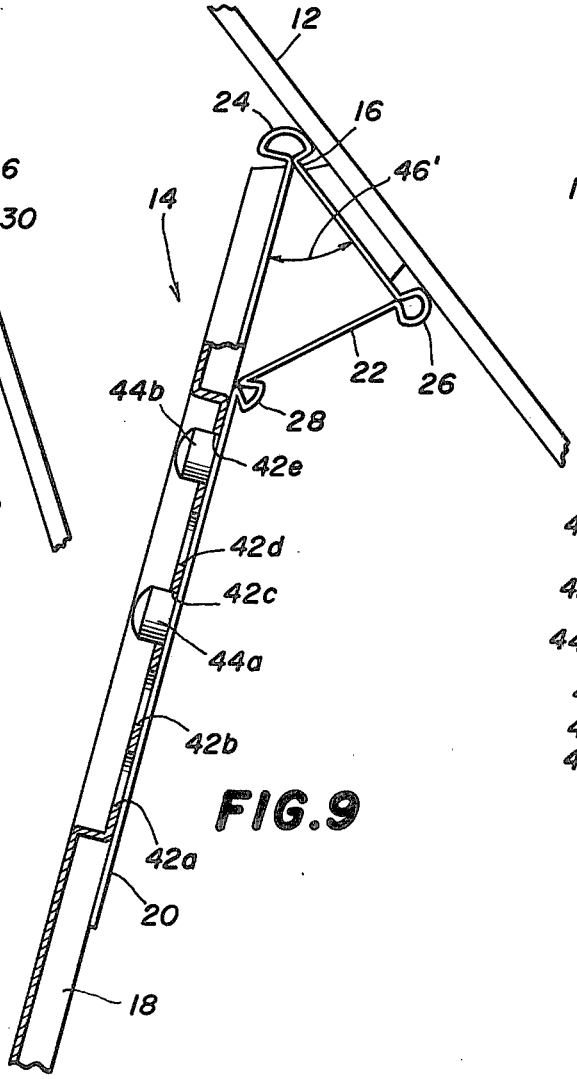
FIG. 9

ONE-PIECE EASEL-SUPPORT MEMBER

SUMMARY OF THE INVENTION

It is an important object of the present invention to provide an improved easel-support member for a picture frame back or the like, which is sturdy in its use position and is inexpensive to manufacture and easy to erect and knock down.

In summary, there is provided a one-piece easel-support member for attachment to a picture frame back or the like and being placeable in storage and use positions and comprising attachment means for attachment to the picture frame back, a stand portion hingedly connected to the attachment means, a flap portion, a link hingedly interconnecting the attachment means and the flap portion, the stand portion being movable to overlie the attachment means in the storage portion of the easel-support member, the stand portion being movable to an acute angle with respect to the attachment means in the use position of the easel-support member, and latching structure including at least one control element and at least one storage element and at least one use element, the control element being integral with one of the portions, the storage element and the use element being integral with the other of the portions, the control element being engageable with the storage element in the storage position of the easel-support member, the control element being engageable with the use element in the use position of the easel-support member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purposes of facilitating an understanding of the invention, there are illustrated in the accompanying drawings, two preferred embodiments thereof from an inspection of which, when considered in connection with the following description, the invention, its construction, and operation, and many of its advantages can be readily understood and appreciated.

FIG. 5 is an enlarged fragmentary view in vertical section of the region encompassing the attachment portion of the easel-support member, in a condition prior to assembly;

FIG. 6 is a view in vertical section on a slightly enlarged scale along the line 6—6 of FIG. 3;

FIG. 7 is a fragmentary side elevation view of the easel-support member in its use position, a condition intermediate the use and storage positions being shown in phantom;

FIG. 8 is a view similar to FIG. 7, but with the easel-support member in its storage position; and FIG. 9 is an alternate embodiment of the invention.

DESCRIPTION OF THE PREFERRED EMBODIMENTS

Figure 1:
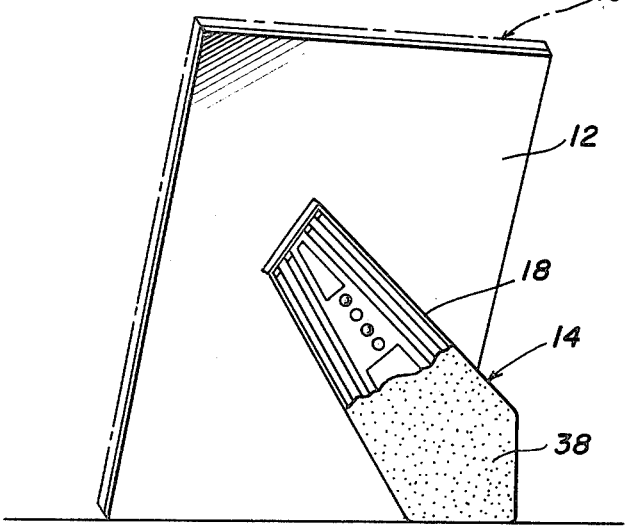
FIG. 1 is a rear view of a picture frame incorporating a one-piece easel-support member embodying the principles of the present invention.

FIG. 1 depicts in phantom a picture frame 10 having the usual back 12 to which is attached a one-piece easel-support member 14 incorporating the features of the present invention. The easel-support member 14 is of one-piece construction and preferably is constructed of plastic. It comprises an attachment region 16, a stand 18, a flap 20 and a link 22, all hingedly connected by hinges 24, 26 and 28. Specifically, the hinge 24 interconnects the attachment region 16 and the stand 18, the hinge 26 connects the attachment region and the link 22, and the hinge 28 connects the flap 20 and the link 22. The hinges 24–28 permit the parts 16–22 to pivot with respect to one another.

The attachment region 16 has a well 30 formed therein defining a bottom wall 32, all as best seen in FIG. 5. In its rest condition, the plane defined by the lines of contact of the hinges 24 and 26 and the picture frame back 12 define a plane which is spaced slightly from the bottom wall 32. When the rivet 34 is applied, the wall 32 is drawn tightly against the picture frame back 12 to provide a secure connection. The stand 18 is preferably provided with ribs 36 for rigidifying the same. The outside of the stand is preferably provided with a decorative facing 38 which can be any desired color. The easel-support member 14 can be attached to the picture frame back 12 by stapling, stitching, etc., instead of the rivets 34.

In order to secure the parts of the easel-support member 14 in their various use and storage positions as will be described, there is provided latching structure 40. In the particular embodiment shown, the latching structure 40 comprises a set of four longitudinally spaced-apart keepers or holes 42*a*, 42*b*, 42*c* and 42*d* in the stand 18, and a pair of longitudinally spaced-apart bosses 44*a* and 44*b* on the flap 20. The diameter of each of the bosses 44*a,b* is slightly greater than the diameter of each of the openings 42*a–d* so that forcing a boss into one of the holes will provide a secure frictional engagement therebetween. Each boss 44*a,b* has a rounded tip to facilitate insertion into selected holes 42*a–d*.

Figure 2:
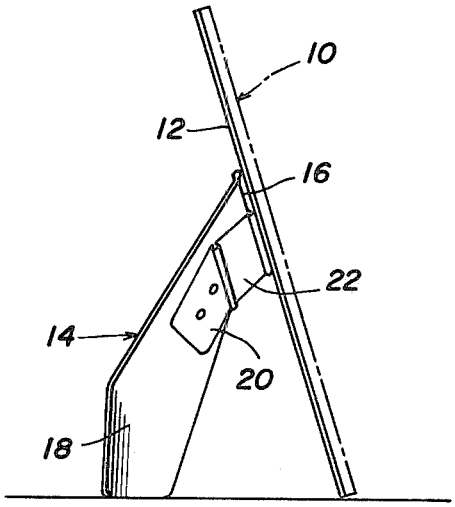
FIG. 2 is a side view of the picture frame and easel-support member.
Figure 3:
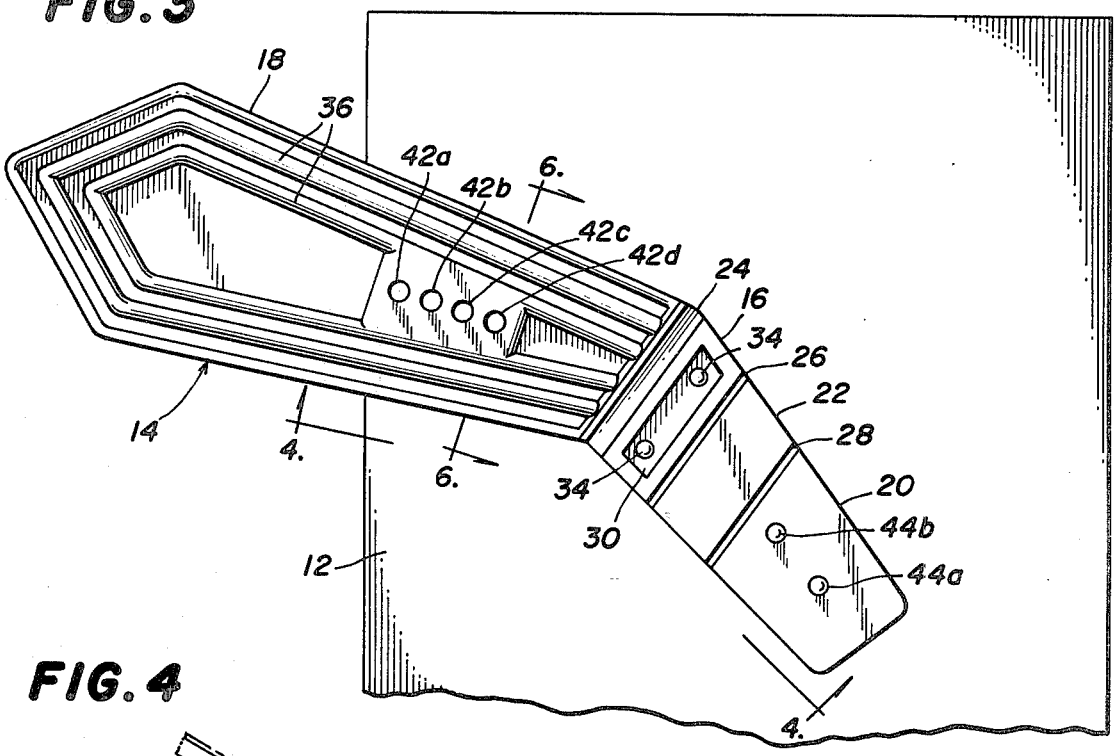
FIG. 3 is a plan view of the back of the picture frame with the easel-support member in its flat or unfolded condition.
Figure 4:
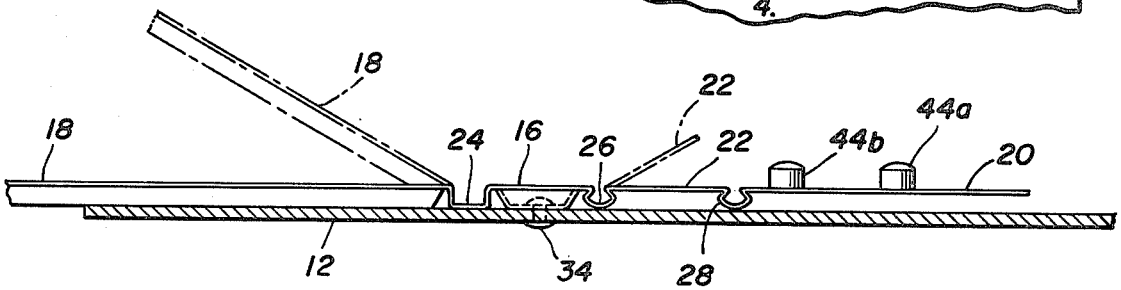
FIG. 4 is an enlarged elevation view taken along line 4—4 of FIG. 3 and showing in phantom intermediate positions of the stand and link.

Referring to FIG. 7, the bosses 44*a* and 44*b* are spaced apart a distance corresponding to the distance between the first and third holes 42*a,c* or 42*b,d*. As shown in FIG. 7, the bosses 44*a* and 44*b* are disposed within and frictionally held by the holes 42*b* and 42*d*. Note the deformation of the hinges 24, 26 and 28 to place the easel-support member in this condition. The acute angle between the attachment region 16 and the stand 18 is represented by the numeral 46. This is the use position of the easel-support member shown in FIGS. 1 and 2 of the drawings. Approximately the same angle results between the stand 18 and the picture frame back 12. This angle is such as to enable the picture frame 10 to stand freely on a support surface such as a desk, table or the like.

The easel-support member may be moved to its storage position as shown in FIG. 8 by grasping the distal end of the flap 20 and forceably removing the bosses 44*a* and 44*b* from the respective holes 42*b* and 42*d* to the phantom line position shown in FIG. 7. Then the stand 18 may be moved toward the picture frame back at which time the bosses 44*a* and 44*b* will become aligned respectively with the holes 42*a* and 42*c* and can be forceably inserted therein as shown in FIG. 8. The stand 18 is now flat against the picture frame back 12 and is held thereby. The easel-support member 14 has been placed in its storage position so that it can be placed in a box or mounted on the wall.

Preferably, the plastic construction is strong enough to withstand repeated withdrawals and entries of the associated bosses into and out of their holes.

The use of two bosses fitting into a pair of holes results in a more rigid construction and a stronger latch. However, the principles of the invention would be applicable to a single boss 44*a* also. Such boss may be viewed as a control element and may be press fit into the storage hole 42*a* to place the easel-support member 14 in its storage position, or press fit into the use hole 42*b* to place the easel-support member 14 in its use position.

The bosses 44*a* and 44*b* may be viewed as a pair of control elements of the latching structure 40 which are respectively inserted in "storage" holes 42*a* and 42*c* since they constitute the holes for latching the support member in its storage position. The holes 42*b* and 42*d* may be considered the "use" holes since they are used to latch the easel-support member 14 in its use or open position.

A second embodiment of the invention is depicted in FIG. 9, in which the easel-support member has precisely the same construction as that shown in FIGS. 1–8 except for the addition of a fifth hole 42*e* in the stand 18. In this embodiment, the easel-support member has two use positions, one in which the angle is shown by the numeral 46 in FIG. 7 and the second represented by the larger angle 46' shown in FIG. 9. The easel-support member can be placed in its second use position by inserting the bosses 44*a* and 44*b* respectively in the openings 42*c* and 42*e*. The conditions to achieve the first use position and the storage position are precisely what was described in respect to the embodiment of FIGS. 1–8.

As was the case in the first embodiment, a single boss 42*a* (or 44*b*) could be used to be placed in the hole 42*a* (first storage position), or 42*b* (first use position or 42*c* (second use position).

In both embodiments, each of the keepers is shown as being just a hole 42*a*–42*e*. Alternatively, these can be covered to define a cylindrical well.

What has been described, therefore, is an improved one-piece easel-support member which is constructed of a single piece of plastic which can readily be placed in use and storage positions.

What is claimed is:

1. A one-piece easel-support member for attachment to a picture frame back or the like and being placeable in storage and use positions and comprising attachment means for attachment to the picture frame back, a stand portion hingedly connected to said attachment means, a flap portion, a link hingedly interconnecting said attachment means and said flap portion, said stand portion being movable to overlie said attachment means in the storage portion of said easel-support member, said stand portion being movable to an acute angle with respect to said attachment means in the use position of said easel-support member, and latching structure including at least one control element and at least one storage element and at least one use element, said control element being integral with one of said portions, said storage element and said use element being integral with the other of said portions, said control element being engageable with said storage element in the storage position of said easel-support member, said control element being engageable with said use element in the use position of said easel-support member.

2. The one-piece easel-support member of claim 1, wherein said easel support member is constructed of plastic.

3. The one-piece easel-support member of claim 1, wherein said flap portion and said link are hingedly interconnected to said attachment means respectively by first and second hinges, said hinges being adapted to contact the picture frame back at points defining a plane, said attachment means including a well formed therein with a bottom wall spaced from said plane, said attachment means including fastener means for drawing said bottom wall tightly against the picture frame back.

4. The one-piece easel-support member of claim 3, wherein said fastening means includes a pair of rivets.

5. The one-piece easel-support member of claim 1, wherein said stand portion has ribs therein for rigidity.

6. The one-piece easel-support member of claim 1, wherein said stand portion has a decorative facing.

7. The one-piece easel-support member of claim 1, wherein said control element is on said flap portion, and said use and storage elements are on said stand portion.

8. The one-piece easel-support member of claim 1, wherein said control element is a boss, and each of said use and storage elements is a hole sized frictionally to engage said boss.

9. The one-piece easel-support member of claim 1, wherein said control element is removable from said use element and said storage element without damage to said easel-support member.

10. A one-piece easel-support member for attachment to a picture frame back or the like and being placeable in a storage position and a plurality of use positions and comprising attachment means for attachment to the picture frame back, a stand portion hingedly connected to said attachment means, a flap portion, a link hingedly interconnecting said attachment means and said flap portion, said stand portion being movable to overlie said attachment means in the storage position of said easel-support member, said stand portion being selectively movable to a plurality of acute angles with respect to said attachment means respectively in the plurality of use position of said easel-support member, latching structure including at least one control element and at least one storage element and a plurality of use elements, said control element being integral with one of said portions, said storage element and said use elements being integral with the other of said portions, said control element being engageable with said storage element in the storage position of said easel-support member, said control element being selectively engageable with said use elements respectively in the plurality of use positions of said easel-support member.

11. The one-piece easel-support member of claim 10, wherein each easel-support member has first and second use positions, said stand member being selectively movable to first and second acute angles respectively in the first and second use positions of said easel-support member, said latching structure including first and second use elements, said control element being selectively engageable with said first and second use elements respectively in the first and second use positions of said easel-support member.

12. The one-piece easel-support member of claim 11, wherein said latching structure includes a second control element on said one portion and first and second further elements on said other portion, said control elements being substantially colinear, said use elements and said storage element and said further elements being substantially colinear, said first and second control elements being respectively engageable with said storage element and said first further element in the storage position of said easel-support member, said first and second control elements being respectively engageable with said first use element and said second further element in said first use position of said easel-support member, said first and second control elements being respectively engageable with said second use element and said storage element in said second use position of said easel-support member.

13. The one-piece easel-support member of claim 10, wherein each of said control elements is a boss, and each of said use and storage elements is a hole sized frictionally to engage said boss.

14. The one-piece easel-support member of claim 1, wherein said control elements are on said flap portion and said use and storage elements are on said stand portion.

15. A one-piece easel-support member for attachment to a picture frame back or the like and being placeable in storage and use positions and comprising attachment means for attachment to the picture frame back, a stand portion hingedly connected to said attachment means, a flap portion, a link hingedly interconnecting said attachment means and said flap portion, said stand portion being movable to overlie said attachment means in the storage position of said easel-support member, said stand portion being movable to an acute angle with respect to said attachment means in the use position of said easel-support member, and latching structure including first and second control elements and first and second storage elements and first and second use elements, said control elements being integral with one of said portions, said storage elements and said use elements being integral with the other of said portions, said first and second control elements being respectively engageable with said first and second storage elements in the storage position of said easel-support member, said first and second control elements being respectively engageable with said first and second use elements in the use position of said easel-support member.

16. The one-piece easel-support member of claim 15 wherein said use elements and said storage elements are substantially colinear.

17. The one-piece easel-support member of claim 16, wherein one of use elements is interposed between said storage elements, and one of said storage elements is interposed between said use elements.

18. The one-piece easel-support member of claim 15, wherein each of said control elements is a boss, and each of said use and storage elements is a hole sized frictionally to engage said boss.

19. The one-piece easel-support member of claim 15, wherein said control elements are on said flap portion and said use and storage elements are on said stand portion.

20. The one-piece easel-support member of claim 19, wherein each of said control elements is a boss, and each of said use and storage elements is a hole sized frictionally to engage said boss.

* * * * *